United States Patent [19]

Burandt et al.

[11] Patent Number: 4,487,109

[45] Date of Patent: Dec. 11, 1984

[54] ELECTRO-HYDRAULIC CONTROL SYSTEM FOR A POWER DRIVE UNIT

[75] Inventors: Wesley A. Burandt; Albert L. Markunas, both of Rockford, Ill.

[73] Assignee: Sundstrand Corporation, Rockford, Ill.

[21] Appl. No.: 363,701

[22] Filed: Mar. 30, 1982

[51] Int. Cl.[3] ..... F01B 13/04; F01B 25/00

[52] U.S. Cl. ..... 91/506; 60/911; 417/217; 417/222

[58] Field of Search ..... 91/506; 60/445, 448, 60/911; 417/217, 222

[56] References Cited

U.S. PATENT DOCUMENTS

| | | | |
|---|---|---|---|
| 3,429,225 | 2/1969 | Keyworth | 91/506 |
| 3,667,225 | 6/1972 | Karman | 60/911 |
| 4,103,489 | 8/1978 | Fletcher | 60/448 |
| 4,139,987 | 2/1979 | Budzich | 60/445 |
| 4,210,066 | 1/1980 | Aldrich | 91/506 |
| 4,351,152 | 9/1982 | Reynolds | 60/448 |

*Primary Examiner*—William L. Freeh

*Attorney, Agent, or Firm*—Harold A. Williamson; Ted E. Killingsworth; Michael B. McMurray

[57] ABSTRACT

The invention relates to an electro-hydraulic control system for a power drive unit having a wobbler controlled variable displacement hydraulic motor wherein the electro-hydraulic control system causes the displacement of the hydraulic motor to match a load to be driven by a power drive unit output shaft coupled to the motor. The system results in the hydraulic motor displacement matching the load as a combined function of the input command signal, the actual wobbler position, as well as the velocity and position of the power drive unit output shaft.

13 Claims, 8 Drawing Figures

POSITION COMMAND
A
t

ACTUAL POSITION
B
t

VELOCITY COMMAND
C
t

ACTUAL VELOCITY
D
t

WOBBLER POSITION COMMAND
MOTOR
E
t
PUMP

ACTUAL WOBBLER POSITION
MOTOR
F
t
PUMP

SERVOVALVE CURRENT
G
t

ELECTRO-HYDRAULIC CONTROL SYSTEM FOR A POWER DRIVE UNIT

TECHNICAL FIELD

This invention relates to an electro-hydraulic control system for an energy efficient variable displacement power drive unit.

BACKGROUND ART

In the aircraft industry there are a myriad of situations where hydraulic power is called upon in airplanes to effect the actuation of a component. The component actuated may be a flap or other flight control surface. The never ending quest for weight reduction and system efficiency has been heightened by the upward spiraling increased cost of fuel, as well as the more exotic environments experienced by high performance fighter aircraft.

Amongst the more recent advances in hydraulic powered actuation systems that embraced the desirable proposition of weight reduction and improved efficiency, is that invention shown and described in the Flippo, U.S. Pat. No. 4,191,094. The Flippo patent shares the same assignee as the applicants in the subject application.

The Flippo patent is directed to a power drive unit for the operation of an aircraft thrust reverser structure in an aircraft engine. The thrust reverser structure is operable between a stow and deploy positions and includes a bi-direction hydraulic motor having a variably positionable wobbler for controlling displacement of the motor. A control structure is provided for causing fluid flow through the motor in either of two directions. The control structure further includes a piston connected to the wobbler for setting the motor at either minimum or maximum conditions or any condition therebetween. A servo valve is also provided for setting the position of the piston in the control cylinder and a differential area piston is operatively connected to the servo valve for positioning thereof. The piston is responsive to the pressure drop across the motor in either direction of operation thereof to set the motor displacement at the least value possible for the load condition on the motor. Flippo also requires reversing hydraulic pressure to the input ports of the hydraulic motor to reverse the direction of the motor, and Flippo controls the speed of his motor by means of a dissipative discharge valve.

The invention to be described hereinafter advantageously distinguishes over Flippo in that the hydraulic motor displacement is additionally controlled as a function of the velocity and position of the power drive output while simultaneously providing regenerative hydraulic power to the control system whenever there is an aiding load experienced by the power drive unit output. The invention to be described hereinafter additionally distinguishes over Flippo in that hydraulic motor reversal does not require the reversing of hydraulic pressure to the ports of the motor and does not require an energy dissipative discharge valve to control the speed of the hydraulic motor.

The advanced state of the art is also shown and described in the U.S. Pat. No. 4,210,066 to Aldrich, which is directed to a power drive unit and includes a bi-directional hydraulic motor having a variably positionable wobbler for controlling displacement of the motor. A control structure is provided that includes a valve for causing fluid flow through the motor in either of two directions. A control cylinder and piston are connected to the wobbler for setting the motor at either minimum or maximum displacement conditions. The Aldrich patent shares the same assignee as the applicants in the subject application.

The Aldrich power drive unit, as advanced as it is, still does not provide the advantageous features enumerated in detail in respect of Flippo above.

The U.S. Pat. No. 3,302,389 to Cadiou, is directed to a regulating device for a barrel-type hydraulic transmission and represents a prior art teaching of a wobbler controlled hydraulic motor wherein the wobbler position and hence motor displacement is a function of input engine velocity, input command and wobbler position. No suggestion is made in Cadiou that the output velocity and position of the drive unit shown functions to control the position of the wobbler as will be evidenced in the description of the invention that will follow.

DISCLOSURE OF INVENTION

The invention more specifically relates to an electro-hydraulic control system for a power drive unit having a wobbler controlled variable displacement hydraulic motor wherein the electro-hydraulic control system causes the displacement of the hydraulic motor to match a load to be driven by a power drive unit output shaft coupled to the motor. The system basically includes an electro-hydraulic servo valve having a controlled moveable valve element which is responsively coupled to the wobbler to cause the wobbler to move in response to an input command signal delivered to a signal summing network which is electrically coupled to the electro-hydraulic servo valve. The wobbler has coupled thereto, a wobbler position transducer unit which is electrically coupled to the electro-hydraulic servo valve via the signal summing network to thereby cause the moveable valve element to be responsive to an actual position of the wobbler. A speed responsive transducer unit is coupled to the power drive unit output shaft and is further electrically coupled via the signal summing network to the electro-hydraulic servo valve to thereby cause the moveable valve element to be responsive to the power drive unit output shaft velocity. The last major component of the system takes the form of an output position transducer unit which is coupled to the power drive unit output shaft and is electrically coupled via the signal summing network to the electro-hydraulic servo valve to thereby cause the moveable valve element to be responsive to the power drive unit output shaft position. The foregoing arrangement results in the hydraulic motor displacement matching the load as a combined function of the input command signal, the actual wobbler position, as well as the velocity and position of the power drive unit output shaft.

It is therefore a primary object of this invention to provide a power drive unit that conserves hydraulic power by varying the hydraulic motor displacement as a combined function of an input load position command, hydraulic motor wobbler position, as well as the velocity and position of the power drive unit output shaft.

Another object of the invention is to provide an electro-hydraulic control system for a power drive unit that causes motor displacement to match the actual loads imposed on the power drive unit output shaft.

Yet another object of the invention is to provide a nonparasitic loss hydraulic control system for a power drive unit which accomplishes through motor displacement control, a minimum hydraulic fluid flow in the system, thereby conserving hydraulic power for use by other means, all without the use of valves or other orifices which dissipate energy and cause pressure losses between the hydraulic system and the hydraulic motors involved.

Another important object of the invention is to provide a nonparasitic loss control system for a power drive unit such that appearance of a load on the output shaft of the unit in the same direction as that commanded by an input command to the system will cause the power drive units variable displacement wobbler controlled motor to operate as a pump and thereby regenerate hydraulic power back into the system for additional useful work by other means.

In the attainment of the foregoing objects, the invention contemplates an electro-hydraulic control system for a power drive unit utilized in a flight control system. The power drive unit includes a wobbler controlled variable displacement motor/pump wherein the electro-hydraulic control system causes the displacement of the hydraulic motor to match a bi-directional load to be driven by a power drive unit output shaft coupled to the motor. The system of the preferred embodiment includes an electro-hydraulic servo valve which has a controlled valve element that is responsively coupled by a hydro-mechanical unit to the wobbler to thereby cause the wobbler to move in response to an input command signal that is delivered to a signal summing network to be described more fully hereinafter. The signal summing network is in turn electrically coupled to the electro-hydraulic servo valve.

The wobbler has mechanically coupled thereto, a wobbler position transducer that is electrically coupled to the servo valve via the signal summing network to thereby cause the moveable valve element to be responsive to an actual position of the wobbler.

A speed responsive transducer unit is coupled to the power drive unit output shaft, and is electrically coupled via the signal summing network to the servo valve to thereby cause the moveable valve element to be responsive to the power drive unit output shaft velocity.

The final component of the system is an output shaft transducer unit which is coupled to the power drive unit output shaft, and is also electrically coupled via the signal summing network to the servo valve to thereby cause the moveable valve element to be responsive to the power drive unit output shaft position.

The signal summing network includes a first summing circuit which receives the input command signal and also receives a power drive unit output position input signal delivered by the output shaft position transducer unit.

The first summing circuit has an output signal, which will represent a velocity command, which signal will be delivered to an input of a second summing circuit, which circuit has another input signal representative of the actual velocity delivered by the speed responsive transducer unit.

The second summing circuit has an output signal that is representative of a wobbler position command. This second summing circuit output signal is delivered to a third summing circuit and provides an input to the third summing circuit. The third summing has another input signal which is representative of the actual wobbler position received from the electrically coupled wobbler position transducer unit.

The third summing circuit has an output signal that is delivered to the servo valve. This output signal from the third summing circuit has a current characteristic of a nature that causes the servo valve, which is responsively coupled to the wobbler, to cause it to move and thereby change the motor displacement. This change in motor displacement allows the motor displacement to match the load as a combined function of the input command signal, the wobbler position, as well as the velocity and position of the power drive unit output shaft.

Other objects and advantages of the present invention will be apparent upon reference to the accompanying description when taken in conjunction with the following drawings:

BEST MODE FOR CARRYING OUT THE INVENTION

Figure 1:
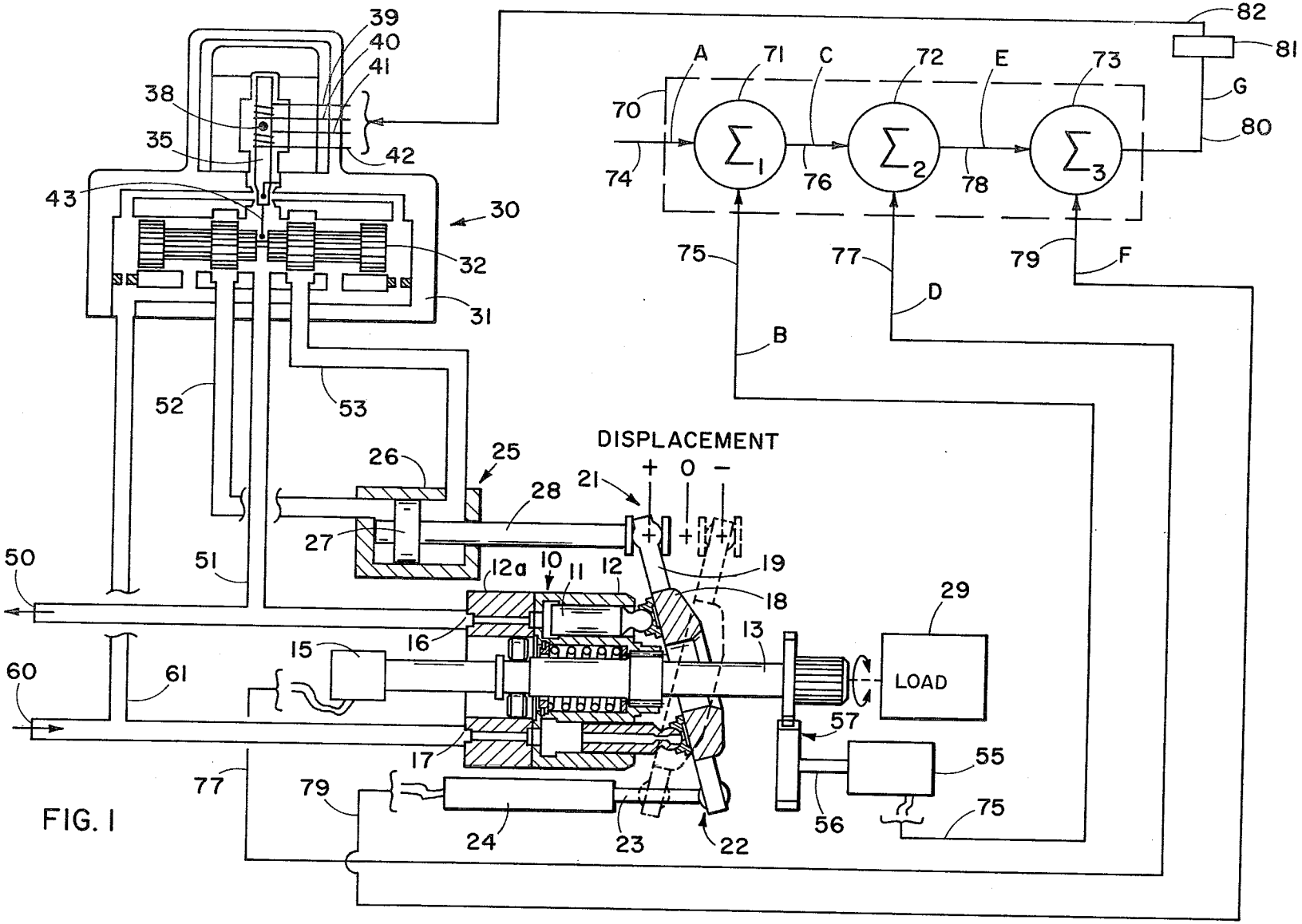
FIG. 1 is a schematic illustration of electro-hydraulic control system for the power drive unit with certain components which show in central vertical section.

Reference is now made to FIG. 1 which illustrates the preferred embodiment of the invention.

The control system for the power drive unit is made up of the following basic components whose function will be described more fully hereinafter.

Shown centrally of FIG. 1 is a variable displacement hydraulic motor, indicated generally at 10, and which in the form shown is an axial piston motor. As is well known in the art, an axial piston motor has a series of pistons 11 carried within a series of longitudinal bores in a cylinder block 12 which connects to an output shaft 13. A port plate 12*a*, forming part of the motor, has a pair of ports 16, 17, one of which 17 receives fluid under pressure from supply port 60, and the other port 16 is connected to return port 50.

The power drive unit disclosed herein provides for infinitely variable positioning of the wobbler 18 to have the wobbler angle change to vary the displacement of cylinder block 12 to thereby cause the hydraulic motor output to match the bi-directional load 29 experienced by output shaft 13.

In contradistinction to earlier approaches that provided reversible motor action by alternately directing the fluid under pressure between the ports of the port plate, the invention herein being described maintains the use of the same supply and return pressure ports throughout the full range of the power drive units operation.

In the instant invention reversal of the hydraulic motor 10 is accomplished by movement of the wobbler 18 from, for example, the position shown to a vertical or zero angle position and then on to the right as the drawing is viewed.

A speed responsive transducer 15 is shown coupled to output shaft 13. The speed responsive transducer 15 provides an electrical signal on lead 77 which is representative of the actual velocity of the output shaft 13.

At the right hand end of output shaft 13 there is shown coupled via gearing 57 and shaft 56, an output shaft position transducer unit 55. The output shaft transducer unit 55 provides a signal on lead 75, which is directly proportional to the actual position of the output shaft 13. It is to be understood that transducers 15, 24 and 55 are conventional units and do not in themselves provide a novel feature of the invention presently being described.

In the upper left hand corner of FIG. 1, an electro-hydraulic servo valve 30 is shown hydraulically coupled to wobbler controlled piston unit 25 by conduits 52, 53. Within the piston unit 25 there is shown a piston 27 secured to a piston rod 28 and moveable in piston sleeve 26. At the right hand end of piston rod 28 is a balljoint 21 which mechanically couples the rod 28 to a wobbler control arm 19, which control arm 19 is integrally connected to wobbler 18.

At the lower end of the wobbler 18 as FIG. 1 is viewed, there is a balljoint 22 which mechanically couples the wobbler 18 to rod 23 which actuates wobbler position transducer 24. Movement of the rod 23 results in a signal appearing on lead 75 which is directly proportional to the wobbler 18 position.

The servo valve 30 includes a valve body 31 and a controlled moveable valve element 32. This servo valve is conventional in construction and responds to signals delivered on lead 82 to coil wires 39, 40, 41, 42 to cause armature 35 to pivot about pivot point 38. Pivotal motion of the armature about point 38 results in blocking a nozzle 43 causing an unbalanced hydraulic force upon valve element 32 to move the valve element 32 to either the right or left as FIG. 1 is viewed. Movement of the valve element causes fluid under pressure to be delivered to either side of piston 27 in a conventional manner from supply port 60 via branch conduit 61 and either conduit 52 or 53.

At the upper right hand corner of FIG. 1 there is illustrated a signal summing network 70 shown in dotted outline. The signal summing network 70 includes first, second and third signal summing circuits respectively referenced as 71, 71 and 73. These signal summing circuits are conventional operational amplifiers, each of which has designed therein gain, limits and compensation as called for by the signal delivered thereto for processing.

Figures 2, 3, 4, 5, 6, 7, 8:
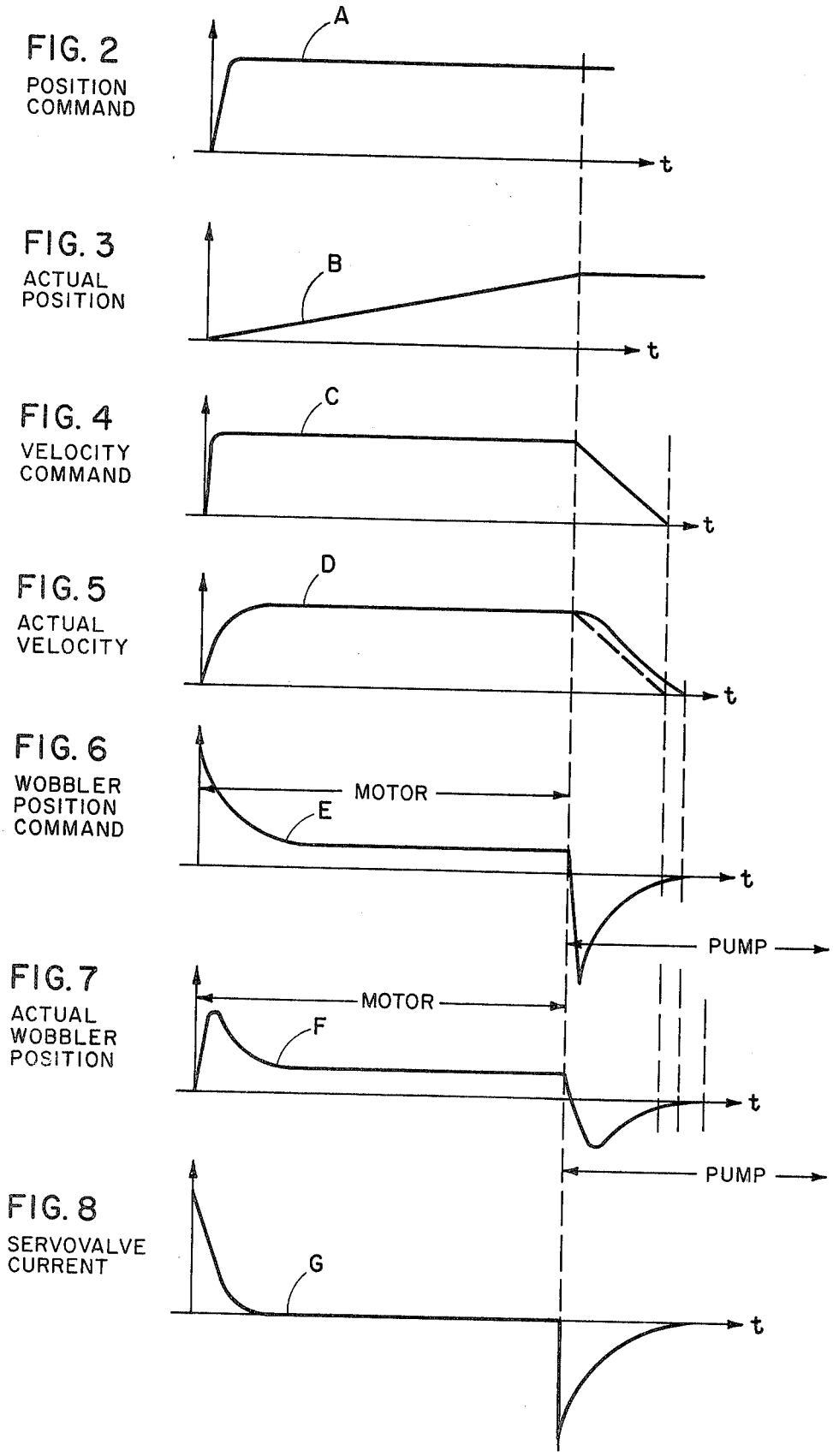
FIGS. 2 through 8 graphically depicts the operational characteristics of the several summing circuit components of the signal summing network of FIG. 1.

The first summing circuit 71 receives an input command signal A, FIG. 2, delivered via lead 74 from the aircrafts pilot. It will be observed that the first summing circuit 71 also simultaneously receives a power drive unit position signal B, FIG. 3, delivered over lead 75 from the output shaft transducer means 55.

The first summing circuit 71 has an output signal C, FIG. 4, which represents a velocity command which is delivered over lead 76 as an input to the second signal summing circuit 72. The second signal summing circuit 72 simultaneously receives over lead 77 another input signal D, FIG. 5, which signal D is representative of the actual velocity of the output shaft being delivered via lead 77 from the speed responsive transducer 15.

The second summing circuit 72 provides an output signal E, FIG. 6, on lead 78 which is representative of a wobbler position command. This second signal summing circuit output signal E provides an input over lead 78 to the third signal summing circuit 73. The third signal summing circuit simultaneously receives over lead 79 from wobbler position transducer 24 an input signal F, FIG. 7.

The third signal summing circuit 73 has an output signal G, FIG. 8, delivered through a conventional current driver 81 over lead 82, the electro-hydraulic servo valve 30. The third signal summing circuit output signal G, has a current characteristic of a nature that causes the servo valve 30, which is respectively coupled to the wobbler, to cause the wobbler to move and thereby change the motor displacement to match the load 29 driven by the power drive unit output shaft 13.

From its foregoing description of the invention, it will be appreciated that the control system of the invention described causes the variable displacement motor to match a lead as a combined function of the input command wobbler position and the velocity of the power drive unit output shaft.

Although this invention has been illustrated and described in connection with the particular embodiment illustrated, it will be apparent that the invention contemplates the substitution of electrical component for the hydraulic components described, all of which can be made without departing from the spirit of the invention as set forth in the appended claims.

We claim:

1. An electro-hydraulic control system for a power drive unit having a wobbler controlled variable displacement hydraulic motor wherein the control system causes the displacement of the hydraulic motor to match a load to be driven by a power driven unit output shaft coupled to said motor, said system comprising:

electro-hydraulic servo means having a controlled moveable means responsively coupled to said wobbler to cause said wobbler to move in response to an input load position command signal delivered to a signal summing means electrically coupled to said electro-hydraulic servo means, said wobbler having coupled thereto a wobbler position transducer means electrically coupled to said electro-hydraulic servo means via said signal summing means to thereby cause said moveable means to be responsive to an actual position of said wobbler, a speed responsive means coupled to said power drive unit output shaft and electrically coupled via said signal summing means to said electro-hydraulic servo means to thereby cause said moveable means to be responsive to said power drive unit output shaft velocity, said signal summing means including a signal summing circuit having a velocity command input signal proportional to said input load position command signal and an actual velocity command input signal delivered by said speed responsive means, said signal summing circuit having an output signal representative of a wobbler position command, said signal summing circuit output signal providing an input to another signal summing circuit, said other signal summing circuit having another input signal representative of said actual wobbler position received from said electrically coupled wobbler position transducer means, said other signal summing circuit having an output delivered to said electro-hydraulic servo means, said other signal summing circuit output signal having a current characteristic of a nature that causes said electro-hydraulic servo means responsively coupled to said wobbler to cause said wobbler to move and thereby change said motor displacement, said hydraulic motor displacement thereby being caused to match said load as a combined function of said input load position command, said wobbler position and said velocity of said power drive unit output shaft, and said control system providing a nonparasitic loss control for said power drive unit such that appearance of said load on said output shaft in the same direction as that commanded by said input load position command to said control system will cause said power drive unit wobbler controlled variable displacement hydraulic motor to operate as a pump and thereby regenerate power back into said system for additional useful work by other means.

2. The control system of claim 1 wherein said moveable means is a valve element.

3. The control system of claim 2 wherein said variable displacement hydraulic motor is of the reciprocating piston type.

4. The control system of claim 3 wherein said hydraulic motor wobbler may be moved so as to provide a change in stroke length of said reciprocating piston hydraulic motor and thereby allow the reversing of said motor.

5. The control system of claim 4 wherein hydromechanical means are provided to couple said valve element to said wobbler to cause said wobbler to be responsively coupled to said valve element to therefore be responsive to said input command signal.

6. The control system of claim 5 wherein said hydromechanical means includes a piston directly mechanically coupled to said wobbler.

7. A control system for a power drive unit having a wobbler controlled variable displacement hydraulic motor wherein the control system causes the displacement of the hydraulic motor to match a load to be driven by a power drive unit output shaft coupled to said motor, said system comprising:

electro-hydraulic servo means having a controlled moveable means responsively coupled to said wobbler to cause said wobbler to move in response to an input load position command signal delivered to a signal summing means electrically coupled to said electro-hydraulic servo means, said wobbler having coupled thereto a wobbler position transducer means electrically coupled to said electro-hydraulic servo means via said signal summing means to thereby cause said moveable means to be responsive to an actual position of said wobbler, a speed responsive means coupled to said power drive unit output shaft and electrically coupled via said signal summing means to said electro-hydraulic servo means to thereby cause said moveable means to be responsive to said power drive unit output shaft velocity, an output shaft position transducer means coupled to said power drive unit output shaft and electrically coupled via said signal summing means to said electro-hydraulic servo means to thereby cause said moveable means to be responsive to said power drive unit output shaft position, said hydraulic motor displacement thereby being caused to match said load as a combined function of said input load position command signal, said wobbler position, as well as said velocity and position of said power drive unit output shaft, and said control system providing system providing a nonparasitic loss control for said power drive unit such that appearance of said load on said output shaft in the same direction as that commanded by said input load position command to said control system will cause said power drive unit wobbler controlled variable displacement hydraulic motor to operate as a pump and thereby regenerate power back into said system for additional useful work by other means.

8. The control system of claim 7 wherein said moveable means is a valve element.

9. The control system of claim 8 wherein said variable displacement hydraulic motor is of the reciprocating piston type.

10. The control system of claim 9 wherein said hydraulic motor wobbler may be moved so as to provide a change in stroke length of said reciprocating piston hydraulic motor and thereby allow the reversing of said motor.

11. The control system of claim 10 wherein hydromechanical means are provided to couple said valve element to said wobbler to cause said wobbler to be responsively coupled to said valve element to therefore be responsive to said input command signal.

12. The control system of claim 11 wherein said hydromechanical means includes a piston directly mechanically coupled to said wobbler.

13. The control system of claim 7 or 12 wherein said signal summing means includes a first signal summing circuit receiving said input load position command signal and a power drive unit output position input signal delivered by said output shaft position transducer means, said first summing circuit having an output velocity command signal delivered to an input of a second signal summing circuit, said second signal summing circuit having another input signal representative of said actual velocity delivered by said speed responsive means, said second summing circuit having an output signal representative of a wobbler position command, said second signal summing circuit output signal providing an input to a third signal summing circuit, said third signal summing circuit having another input signal representative of said actual wobbler position received from said electrically coupled wobbler position transducer means, said third signal summing circuit having an output signal delivered to said electro-hydraulic servo means, said third summing circuit output signal having a current characteristic of a nature that causes said electro-hydraulic servo means responsively coupled to said wobbler to cause said wobbler to move and thereby change said motor displacement to match said load to be driven by said power drive unit output shaft.

* * * * *